US006942606B2

(12) United States Patent
Womer et al.

(10) Patent No.: US 6,942,606 B2
(45) Date of Patent: Sep. 13, 2005

(54) ROLL HAVING MULTIPLE FLUID FLOW CHANNELS FOR USE IN PRODUCING AND PROCESSING SHEET MATERIAL

(75) Inventors: Timothy W. Womer, Edinburg, PA (US); Bradley C. Quick, Aurora, OH (US); George R. Cozzarin, Stow, OH (US)

(73) Assignee: New Castle Industries, Inc., New Castle, PA (US)

( * ) Notice: Subject to any disclaimer, the term of this patent is extended or adjusted under 35 U.S.C. 154(b) by 25 days.

(21) Appl. No.: 10/612,204

(22) Filed: Jul. 2, 2003

(65) Prior Publication Data

US 2005/0003939 A1 Jan. 6, 2005

(51) Int. Cl.[7] ..... F16C 13/00
(52) U.S. Cl. ..... 492/46; 492/43
(58) Field of Search ..... 492/46, 43, 47

(56) References Cited

U.S. PATENT DOCUMENTS

| | | | | |
|---|---|---|---|---|
| 242,058 | A | 5/1881 | Schurmann | |
| 3,328,866 | A | 7/1967 | Robertson | |
| 3,548,929 | A | 12/1970 | Gross | |
| 3,625,280 | A | 12/1971 | Peter | |
| 3,676,910 | A | 7/1972 | Gross | |
| 3,840,958 | A | 10/1974 | Mahn | |
| 3,852,860 | A | 12/1974 | Tewes | |
| 4,158,128 | A | 6/1979 | Evdokimov et al. | |
| 4,232,834 | A | 11/1980 | Player et al. | |
| 4,233,011 | A | 11/1980 | Bolender et al. | |
| 4,305,191 | A | 12/1981 | Enomoto | |
| 4,363,615 | A | 12/1982 | Bolender | |
| 4,498,527 | A | 2/1985 | Gerarts et al. | |
| 4,683,628 | A | 8/1987 | Schonemann | |
| 4,823,450 | A | 4/1989 | Ramisch et al. | |
| 5,103,542 | A | 4/1992 | Niskanen | |
| 5,392,702 | A | 2/1995 | Suzuki | |
| 5,549,154 | A | 8/1996 | Niskanen et al. | |
| 5,567,448 | A | * 10/1996 | Frankland | 425/363 |
| 6,315,703 | B1 | 11/2001 | Quack et al. | |
| 6,453,713 | B1 | 9/2002 | Womer et al. | |
| 6,468,461 | B1 | 10/2002 | Sumiyoshi et al. | |

* cited by examiner

*Primary Examiner*—Marc Jimenez
(74) *Attorney, Agent, or Firm*—Robert Herberger

(57) ABSTRACT

A heat transfer roll for producing sheet material, particularly material having a cross-section whose thickness varies across the width of a sheet being formed, includes a journal on which the roll is rotatably supported, and at least two cooling channels at the surface of the roll that can be supplied with various fluids at various flow rates and temperatures. Fluid in the first and second channels flows at predetermined longitudinal positions at the roll surface. The first channel includes cylindrical spiral portions and the second channel includes a circular cylindrical channel located between the spiral portions. A diverter provides hydraulic flow continuity across the second flow channel to first and second portions of the first flow channel. Risers carry fluid radially outward to the flow channels at the outer surface of the roll.

20 Claims, 3 Drawing Sheets

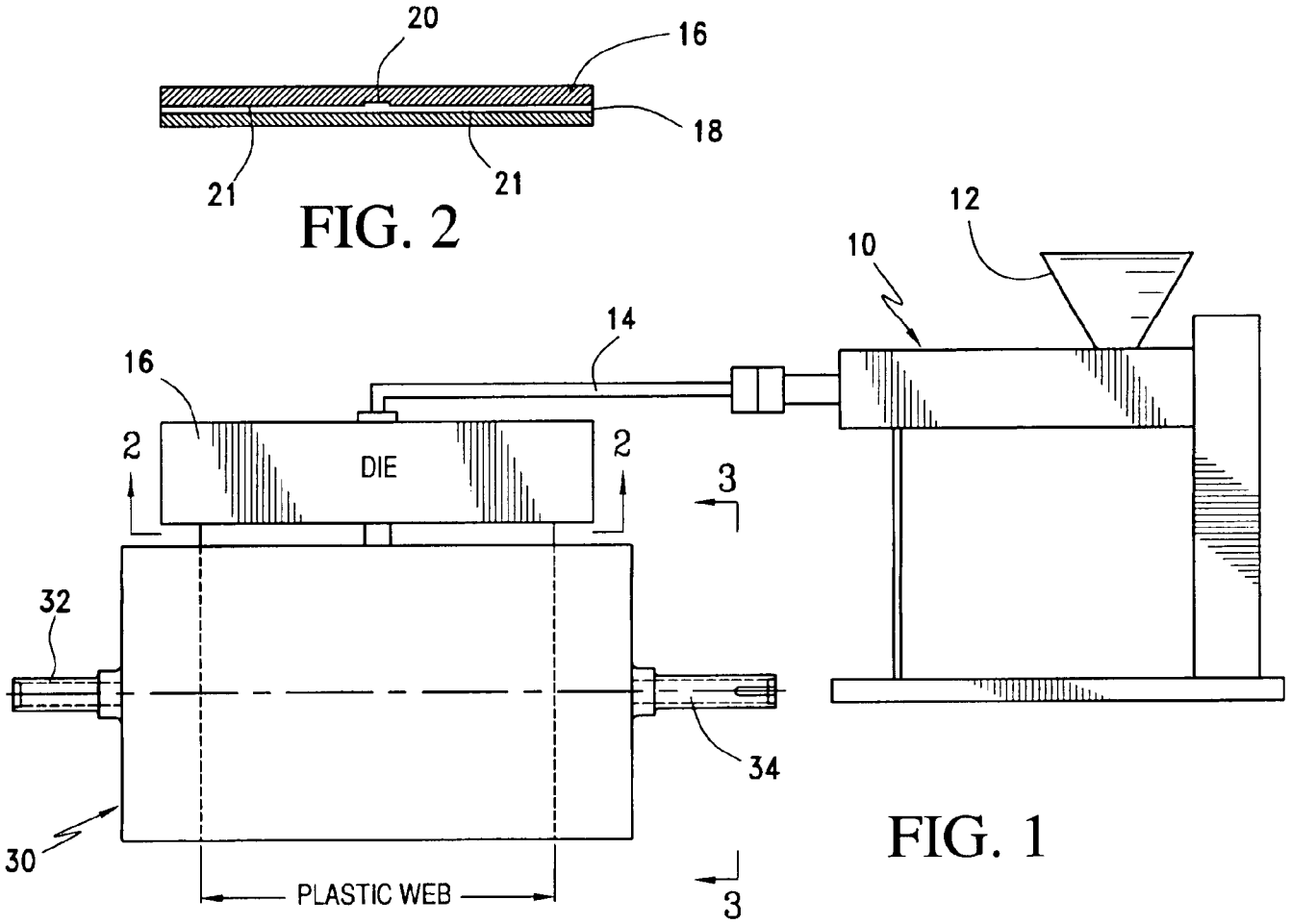
FIG. 1
FIG. 2
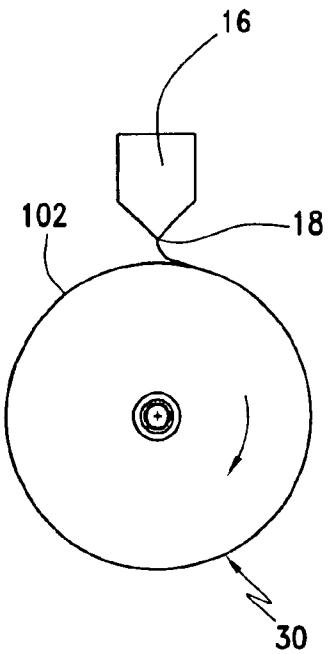
FIG. 3

ROLL HAVING MULTIPLE FLUID FLOW CHANNELS FOR USE IN PRODUCING AND PROCESSING SHEET MATERIAL

BACKGROUND OF THE INVENTION

1. Field of the Invention

This invention relates to the field of process rolls, more particularly it pertains to heat transfer rolls for use in the production and processing of sheets of material, such as paper, plastic and rubber.

2. Description of the Prior Art

The principal techniques for manufacturing wide sheets of polymer, such as plastic, or of paper are an extrusion process and a cast film process. The flat sheet extrusion process is used to produce plastic sheet by pressing molten polymer material between two or more rolls that serve to flatten the material into a continuous sheet having a desired thickness. The material passes around and between multiple rolls during production and processing of the sheet. Often a pull roll is used to keep tension in the extruded flat sheet as it exits the final roll. The sheet is then continuously rolled on a core, or it is cut and stacked in flat sheets.

U.S. Pat. No. 5,567,448 describes a heat transfer roll for use in forming flat sheet material by an extrusion process. The roll includes a core, a shell surrounding the core and a duct, through which fluid for controlling the temperature of the sheet flows from the core to the shell. The roll extrudes sheet having a uniform thickness across its width and provides one cooling fluid flow passageway. The roll has no provision for multiple fluid channels and cannot accommodate variable sheet thickness or a variable heat content of sheet material across the width.

Various techniques have been employed to control the temperature on the surface of a roll used to form sheets of paper or plastic. For example, U.S. Pat. No. 4,233,011 describes a roll having a cylindrical core, a tubular shell surrounding the core, and a heating strip carried on the core. Temperature sensors located on the core are used to produce a signal employed by an electrical regulating circuit that controls the application of electric power supplied to the heating strip. The heating strip is regulated so that a predetermined temperature difference between the heated and unheated sides of the core is maintained. The purpose of maintaining this temperature difference on the core is to produce thermal displacement or arching of the core. That displacement is transmitted to the shell. U.S. Pat. No. 5,103,542 describes a fluid distribution system for a variable-crown roll that includes a stationary central axis and a revolving shell surrounding the axis. The fluid distribution system includes a system of ducts in which pressurized fluid enters isolated areas on the roll. The fluid distribution system includes axial ducts and transverse bores that direct fluid to hydraulic loading elements to compensate for stresses resulting during processing. Neither of these patent references describes the use of multiple temperature channels on a forming roll.

Rolls for forming sheet material have conventionally included an annular passage located between a core and a shell surrounding the core. Fluid for cooling the sheet material flows in the annular passage along a spiral path bounded by partition strips that extend radially between the core and the inner surface of the outer shell. U.S. Pat. Nos. 3,548,929 and 3,676,910 describe rolls having a spiral fluid flow channel. The '910 patent describes a machine for forming T-shaped fins that include a sealing gasket, the fins being used as a spiral seal between the core and outer shell of a fluid heat exchanger type roll. The '929 patent describes use of a continuous partition strip arranged in a spiral and located in an annular space between the core and outer shell of the roll. The partition strip is formed of a composite structure that can withstand the chemical and thermal action of certain fluids used for heat transfer purposes that tend to corrode or decompose partitions made of rubber and plastic.

The process for producing long, wide, thin sheet material of plastic, paper and similar materials by the cast film processing includes use of an extruder that delivers molten material in a fluid state to a die. The die has a profiled opening or orifice that forms the surface contour of the sheet as the molten polymer passes through the die orifice to form an elongated sheet width. The sheet may have relatively thick areas spaced across the elongated width and extending continuously along the length of the sheet.

Accordingly, the rate of cooling of the cast sheet product varies across the sheet, that rate being longer in the areas of thick sheet and shorter in the areas of thin sheet. There is need for a heat transfer roll that accommodates the cooling requirement differences across the sheet width by providing multiple cooling channels located within the roll and located appropriately to correspond to the location of thick and thin sheet areas.

SUMMARY OF THE INVENTION

In one of its embodiments, the present invention provides a heat transfer roll on which molten sheet material is cooled, the roll including a first cylindrical shell; a second cylindrical shell surrounding the first shell, and defining a cylindrical annular space therebetween, said space having an axial length and a periphery; a first flow channel located in said space, extending along a first portion of the axial length and around the periphery of said space, having a first inlet and a first outlet; and a second flow channel located in said space, extending along a second portion of the axial length and around the periphery of said space, having a second inlet and a second outlet.

In another of its embodiments this invention contemplates a method for forming a long sheet of material having a cross-section with a width and a thickness, the thickness having a relatively thin area and a relatively thick area, the thin area extending across a first portion of the width, and the thick area extending across a second portion of the width, or vice versa. The method comprising the steps of passing molten material through a die having an orifice with a shape complementary to the cross-section of sheet being produced; placing said passed sheet on a roll having a surface exposed to a first flow channel and a second flow channel; locating the sheet on the roll such that the lateral location of the thin area corresponds to the lateral location of the first flow channel, and such that the lateral location of the thick area corresponds to the lateral location of the second flow channel; supplying fluid from a first fluid source to the first flow channel; and supplying fluid from a second fluid source to the second flow channel.

As previously described, a molten sheet having varied thickness cross-sectional profiles will have different solidification times at the thinner and thicker portions of the sheet. As a result, cooling of the molten material at one rate causes degradation and varied shrinkage as portions solidified across the profile as different times. By increasing the cooling rate of the thicker profiles so that it substantially matches the time of solidification of the thinner profiles, the quality of the product is improved. Therefore, a multiple thermal channel roll according to the present invention allows a wider operating range of thicker verses thinner sheet profiles due to the wider cooling ranges between the thermal channels.

Further, because thicker portions of the molten sheet material can be cooled faster by appropriate choice of coolant and other process variables, a roll having multiple coolant temperature channels according to the present invention permits the process line speed to be increased compared to the speed using a conventional forming roll.

It is still another advantage of this invention that different cooling fluids can be used in each fluid flow channel to maximize the heat transfer from the sheet material to the coolant in the several cooling channels on the roll. It is yet another advantage that both heating and cooling channels can be used when producing sheet material of composite materials having substantially different thermal properties.

BRIEF DESCRIPTION OF THE DRAWINGS

It is to be understood that the drawings are designed for the purpose of illustration only and not as a definition of the limits of the instant invention, for which reference should be made to the claims appended hereto. Other features, objects and advantages of this invention will become clear from the following more detailed description made with reference to the drawings in which:

FIG. 1 is a diagram representing process steps for producing thin sheet by the cast film process employing a roll having multiple thermal channels according to the present invention;

FIG. 2 a front elevation view taken at plane 2—2 of FIG. 1 showing a non-uniform cross-sectional contour profile on a sheet leaving a die;

FIG. 3 is a side elevation view taken at plane 3—3 of FIG. 1;

DETAILED DESCRIPTION OF THE PREFERRED EMBODIMENTS

Figure 4:
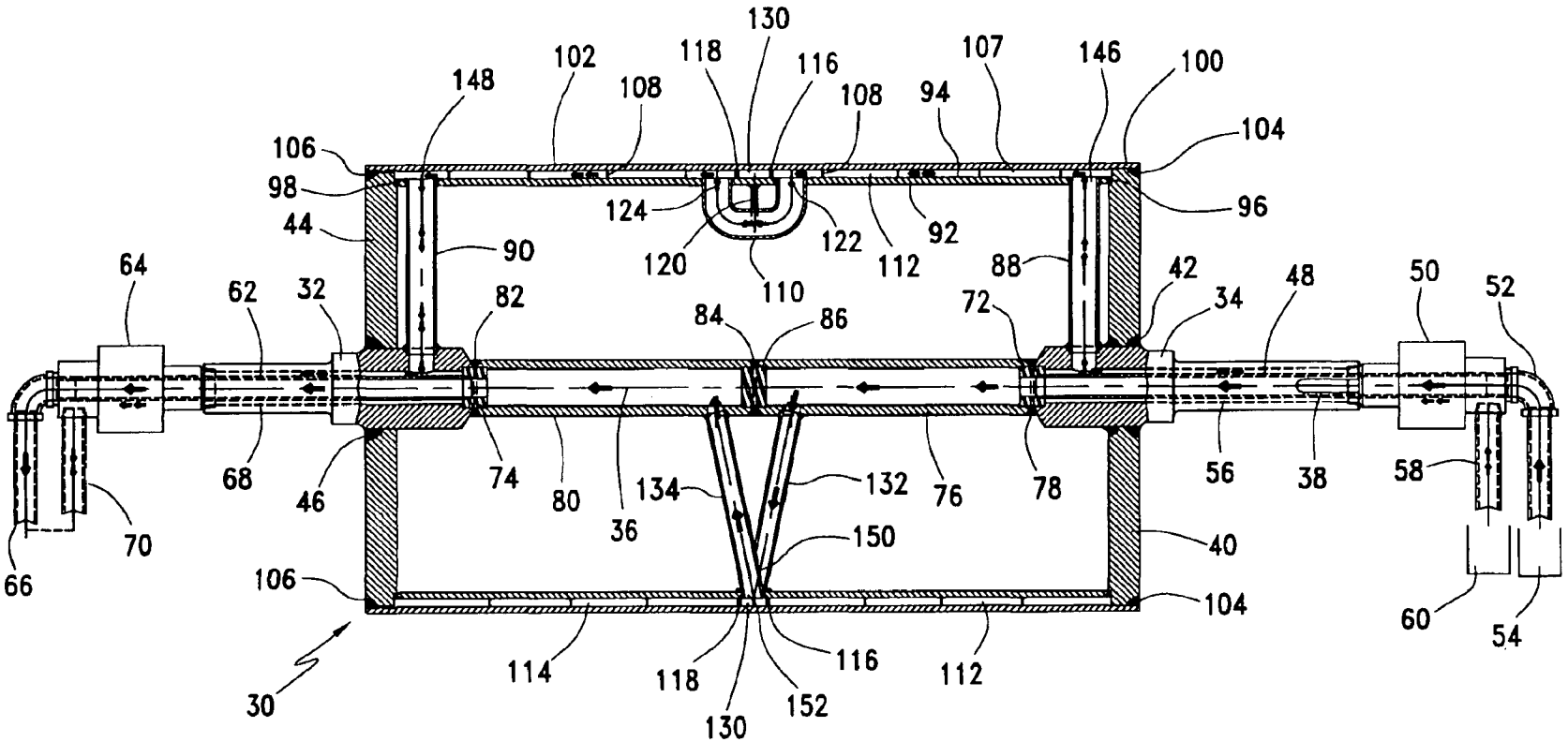
FIG. 4 is a cross section taken through a central longitudinal axis of a process roll according to the present invention.

Turning first to FIG. 1, 2 and 3, the process equipment and machinery for producing long, wide, thin sheet material of plastic, paper and similar materials by cast film processing includes an extruder, shown generally at 10, which receives stock, such as polymer through a bin 12. The extruder delivers molten material in a fluid state through a conduit 14 to a die 16. The die has a profiled orifice 18 that forms the surface contour and cross-sectional profile of the sheet as the molten polymer passes through the die orifice. The shape of the die orifice 18 is the complement of the surface contour and cross-sectional profile of the sheet being produced. The sheet may have relatively thick areas 20, shown in FIG. 2 in the form of projections, spaced mutually across the width and extending continuously along the length of the sheet, the projections being separated by thin, flat areas 21, which also extend continuously along the length of the sheet.

The sheet material leaves the die 16 and passes over a heat transfer roll 30, supported for rotation at each axial end on journals 32, 34. An air knife may be used to force the sheet closely against the heat transfer roll 30. The sheet is cooled on the outer surface of roll 30 and cut into lengths by a secondary process before final assembly or subsequent processing.

FIG. 4 illustrates the roll 30, according to the present invention, for use in forming sheet material having thicknesses, heat content properties, and cooling rate requirements that vary across the width of the sheet. The roll includes left-hand and right-hand journals, 32, 34, which are formed in a known manner to be received in conventional bearings or pillow blocks, on which the roll is supported for rotation about a central axis 36. Preferably each journal 32, 34 includes a keyway 38, through which power is transmitted from an external source to rotate the roll about axis 36. At the right-hand end of the roll, a circular end plate 40 is secured to the right-hand journal 34 by a welded connection 42. At the left-hand side of the roll, another circular end plate 44 is secured by a circular weld 46 to the outer surface of the left-hand journal 32.

Located within the right-hand journal 34, at the fluid inlet side of the roll 30, is a siphon tube 48, which is connected through a rotary union 50 to a first source conduit 52, which is hydraulically connected to a first source of fluid liquid 54, i.e., chilled or heated fluid. Surrounding the siphon tube 48 and located in an annular passageway between the outer wall of the right-hand journal 34 and the wall of siphon tube 48 is a fluid journal-passage 56, which is similarly connected through the rotary union 50 to a second source conduit 58 connected to a second fluid source 60 holding heat transfer fluid or liquid.

Located within the left-hand journal 32, at the fluid outlet side of the roll 30, is a siphon tube 62, which is hydraulically connected through a rotary union 64 to a conduit 66, through which fluid is returned to the first fluid source 54. Surrounding the siphon tube 62 and located in an annular passageway between the outer wall of journal 32 and the wall of siphon tube 62 is a fluid journal-passage 68, which is similarly connected through the rotary union 64 to a conduit 70, through which fluid is returned to the second fluid source 60.

A first siphon plug 72 forms a bulkhead that blocks and closes the end of the fluid journal-passage 56 in the right-hand journal 34. Similarly, a second siphon plug 74 closes the end of the fluid journal-passage 68 in the left-hand journal 32.

A first tube 76 is fixed by a weld 78 to the inner end of the right-hand journal 34, and a second tube 80 is fixed by a weld 82 to the inner end of said left-hand journal 32. The ends of tubes 76, 80 are mutually connected by a center weld 84. The siphon tube 48 is hydraulically connected to the tube 76, which is blocked by a third siphon plug 86, but tube 76 is blocked by the first siphon plug 72 from communication with the annular journal-passage 56. The tube 80 is in direct fluid communication with the siphon tube passage 62, but tube 80 is blocked by the second siphon plug 74 from communication with annular journal-passage 68.

Extending radially outward from the axis 36 and fixed to the right-hand journal 34 is a first riser pipe 88, which is in fluid communication with annular journal-passage 56. Similarly, a second riser pipe 90 is fixed to said left-hand journal 32 and extends radially outward from axis 36. The second riser pipe 90 is in fluid communication with the annular journal-passage 68.

Located at the radially outer end of the riser pipes 88, 90 is an inner shell 92 providing a circular cylindrical outer surface 94. The inner shell 92 is sealed and joined by a weld 96 to end plate 40, and inner shell 92 is sealed and joined to end plate 44 by a weld 98.

Spaced radially from the cylindrical surface 94 of the inner shell 92 is an outer shell 100, which has an outer circular cylindrical surface 102, joined and sealed at the inlet and outlet sides of the roll to the end plates 40, 44 by welds 104, 106. Located within the cylindrical annular space 107 between the inner shell 92 and outer shell 100 are spiral-shaped seals 108.

Located approximately midway between the riser pipes 88, 90 is a diverter 110 in a form of tube communicating with a spiral channel having portions 112, 114 located at opposite axial sides of the diverter 110. Communication between the spiral portions 112,114 is blocked by circular seals 116, 118, which extend around the circumference of the inner shell 92. The diverter pipe 110 is fixed to the inner shell 92 and is supported on the shell by a hanger flange 120.

An annular channel portion 130 located between seals 116, 118 is hydraulically connected and supplied with fluid from the first fluid source 54 through the first tube 76 and a third riser pipe 132. The annular channel portion 130 is hydraulically connected also to the second tube 80 by a fourth riser pipe 134.

In this way, the roll 30 contains first and second flow channels, each channel hydraulically connected to one of the fluid sources 54, 60. The first flow channel for carrying coolant from the inlet side to the outlet side of roll 30 is supplied from the second fluid source 60, through conduit 58, rotary union 50, journal-passage 56, and first riser pipe 88 to the spiral channel portion 112 located in annular space 107, between inner shell 92 and outer shell 100. Diverter 110 carries fluid around the annular channel portion 130, bounded by circular seals 116 and 118, to the spiral channel portion 114. The second riser pipe 90 carries fluid from spiral portion 114 to the journal-passage 68 located between the inner wall of the left-hand journal 32 and the outer wall of siphon tube 62, through rotary union 64, and conduit 70 for return to fluid source 60.

The second fluid flow channel for carrying coolant from the inlet side to the outlet side of roll 30 is supplied from the first fluid source 54, through conduit 52, rotary union 50, siphon tube 48, tube 76, and the third riser pipe 132 to the annular channel portion 130 located in the annular-space 107 between the circular seals 116, 118. The fourth riser pipe 134 carries hydraulic fluid from the annular channel portion 130, through tube 80, siphon tube 62, rotary union 64, and conduit 66 for return to fluid source 54.

In this embodiment, the roll defines a first outer cooling channel having a first spiral portion 112 that extends longitudinally on the outer cylindrical surface 102 of the outer shell 100 between end plate 40 and seal 116, and having a second spiral portion 114 located on the outer cylindrical surface 102 of outer shell 100 and extending longitudinally between circular seal 118 and the end plate 44. The roll also includes an annular cooling channel portion 130 in its center, located on the outer circular surface 102 of outer shell 100 extending longitudinally between circular seals 116 and 118.

The radially outer end of the first riser pipe 88 communicates with the spiral portion 112 of the first flow channel through an inlet 146, through which fluid enters the spiral portion 112 of the first flow channel. The radially outer end of the second riser pipe 90 communicates with the spiral portion 114 of the first flow channel through an outlet 148, through which fluid exits the spiral portion 114 of the first flow channel. Fluid flow continuity between the spiral portions 112, 114 is provided by the diverter 110, which has an inlet 122 through which fluid exits spiral portion 112 and enters diverter 110, and an outlet 124 through which fluid leaves diverter 110 and enters spiral portion 114.

Similarly, the radially outer end of the third riser pipe 132 communicates with the second flow channel, being the cylindrically annular channel portion 130, via an inlet 150, through which fluid enters the annular channel portion 130. The radially outer end of the fourth riser pipe 134 also communicates with the annular channel portion 130 of the second flow channel via an outlet 152, through which fluid exits the annular channel portion 130 and enters riser pipe 134. Fluid flow continuity between riser pipes 132 and 134 is provided by channel portion 130.

Figure 5:
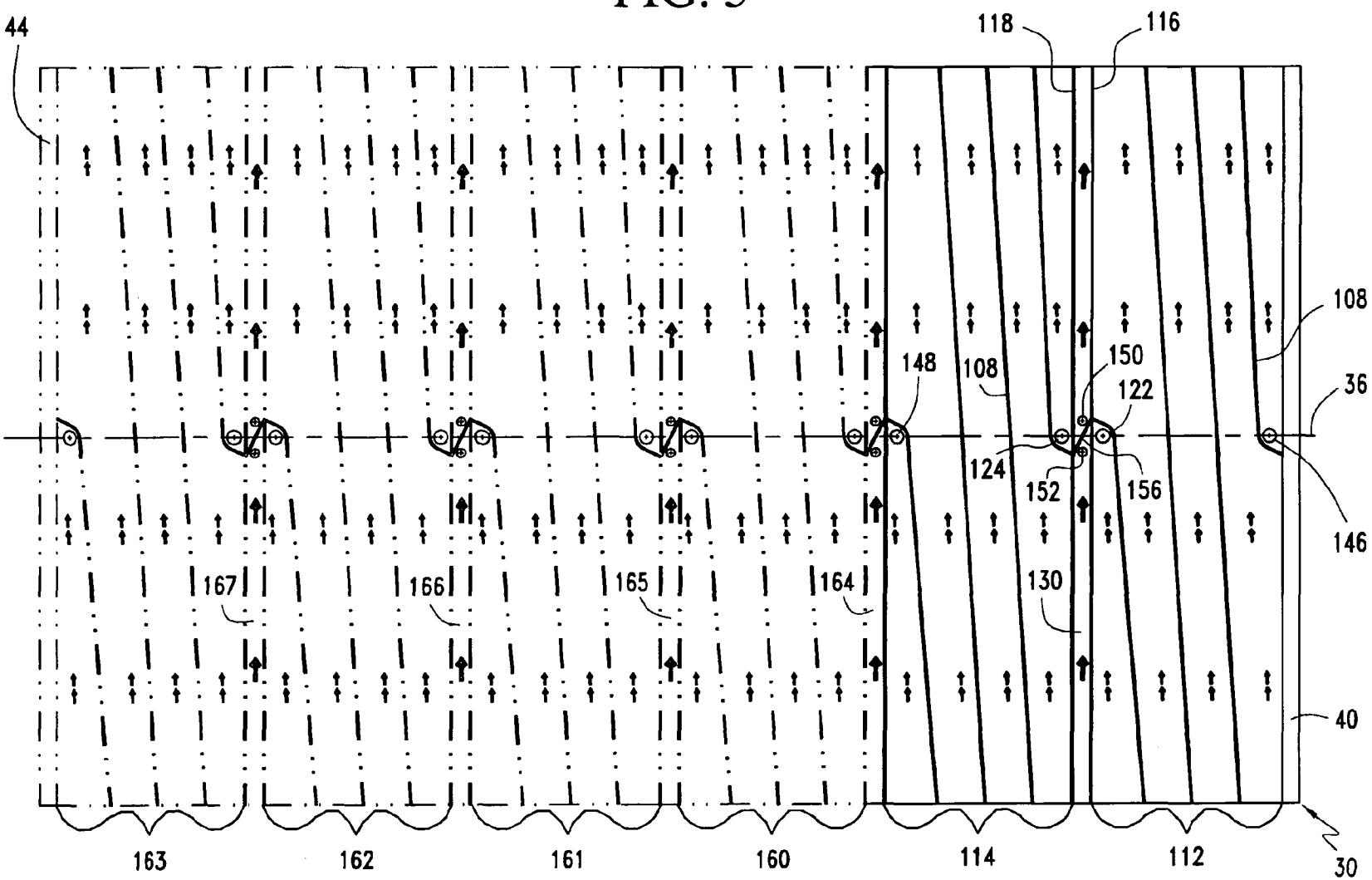
FIG. 5 is a view looking radially inward toward the inner shell with the outer shell removed and the cylindrical surface of the outer shell projected into a horizontal plane.

FIG. 5 shows an embodiment of a multi-channel arrangement with spiral seal 108 and circular seals 116, 118, viewed radially inward with outer shell 100 removed and the cylindrical outer surface of the inner shell 92 of the roll 30 in a horizontal plane. The spiral channel portion 112 of the first flow channel extends longitudinally along axis 36 from the inner surface of end plate 40 to seal 116. Spiral portion 112, which is located in the annular space between the outer shell 100 and inner shell 92, entirely encircle the inner shell 92 several times. FIG. 5 shows spiral portion 112 extending four times around the circumference of the roll 30.

Spiral seal 108 abuts end plate 40 and travels angularly about and axially along the outer surface of inner shell 92 in a spiral path. The radially outer end of seal 108 contacts the inner surface of the outer shell 100, thereby sealing the outer surface of inner shell 92 and the inner surface of outer shell 100 against fluid flow across seal 108, and directing flow along the length of seal 108. Therefore, fluid entering channel portion 112 from inlet 146 flows along a spiral path bounded by shells 92, 100 and seal 108, to inlet 122, where the fluid enters diverter 100. Fluid in the first flow channel then leaves diverter 100 through outlet 124, enters the spiral channel portion 114, and flows along channel portion 114 to the outlet 148. Fluid in the first flow channel would then leave the roll through the second riser pipe 90 and journal-passage 68, rotary union 60 and conduit 70.

Preferably, but not always, the axial pitch of the spiral about the axis 36 in the spiral portion 112 decreases angularly from the inlet 146 as the seal 108 extends away from end plate 40 toward circular seal 116. After then passing through diverter 110, fluid enters the spiral portion 114. Similarly, as seal 108 moves away from the circular seal 118, in the spiral portion 114, the axial pitch of the spiral gets smaller and the width of the channel increases, so that resonance time of the fluid passing therethrough increases. In this way, the resonance time of the cooling fluid increases as the fluid moves through channel portions 112, 114 from inlet 146 to outlet 148, so as to maintain uniform cooling of the sheet across its width.

Circular seals 116, 118 are supported on the outer surface of inner shell 92 and travel along the circumference of the outer surface of inner shell 92 in a circular path. The radially outer end of seals 116, 118 contact the inner surface of the outer shell 100, thereby sealing those surfaces of the shells against fluid flow across seals 116, 118, and directing flow in the annular channel portion 130 along the length of those seals.

In the vicinity of the diverter inlet 122 and outlet 124, the inlet 150 of the third riser pipe 132 and outlet 152 of the fourth riser pipe 134 are sealed mutually by transverse seal 156. In this way, fluid entering the annular flow channel portion 130 through the inlet 150 from riser pipe 132 flows about axis 36 and along the annular space bounded by seals 116, 118, the outer surface of inner shell 92 and the inner surface of outer shell 100, to the outlet 152 at riser pipe 134. Then fluid in this second fluid flow channel enters tube 80 and exits the roll through the siphon tube 62 in the journal 32, rotary union 64 and conduit 66.

Continuing to focus in the vicinity of the diverter inlet 122 and outlet 124, seal 108 either continues uninterrupted past seals 116, 118, or seals 116, 118 continue uninterrupted past seal 108. In either case, transverse seal 156 prevents direct communication between the inlet 150 and outlet 152 of riser pipes 132, 134, and seal 108 continues its spiral path angularly about and axially along axis 36 from the diverter outlet 124 to the outlet 148 of riser pipe 90.

Although the first flow channel shown in FIG. 4 has been described as having only two spiral flow portions 112, 114, separated by the second flow channel having one annular flow channel portion 130, there may be any suitable number of first flow channel portions and second flow channel portions as shown in FIG. 5. Accordingly any number of diverters 110 and riser pipes 88, 90, 132, 134 that are needed to accommodate the fluid cooling requirements of the surface profile or contour of the sheet being produced by the process can be added to the roll. For example, FIG. 5 shows six spiral flow channel portions 112, 114, 160, 161, 162, 163 of the first fluid flow channel, each separated by one of five secondary fluid flow channels having portions 130, 164, 165, 166, 167.

Also, the direction of fluid flow in either or both of the spiral fluid flow channel portions 112, 114 and the annular channel portion 130 can be reversed so that fluid flows clockwise in one channel and counterclockwise in another channel when viewed from a lateral side of the roll. Each flow channel can also contain a different fluid. The linear flow rate of fluid and mass flow rates of fluid in each channel may differ mutually. Further, the flow channels can be provided with turbulators and other such devices for increasing the degree of turbulent fluid flow through the channels in order to increase the rate of heat transfer through the various portions of the outer shell wall.

Furthermore, the first and second flow channels need not be cylindrical spirals and annular, as described here, but may have any suitable form and combination. The axial width of the various portions of the first flow channel may be mutually equal or they may differ from one another to optimize heat transfer. Similarly, the axial width of the second flow channel portions may differ mutually and in relation to the widths of the first flow channel portions in accordance with the cooling requirements of the sheet being produced.

Although the invention has been shown in connection with certain specific embodiments, it will be readily apparent to those skilled in the art that various changes in form and arrangement of parts and method steps may be made to suit requirements without departing from the spirit and scope of the invention.

What is claimed is:

1. A heat transfer roll on which sheet material is processed, comprising:

a first cylindrical shell;

a second cylindrical shell surrounding the first shell, and defining a cylindrical annular space therebetween, said space having an axial length and a periphery;

a first flow channel located in said annular space, extending along a first portion of the axial length and around the periphery of said annular space, the first flow channel having a first inlet and a first outlet; and a second flow channel located in said annular space, extending along a second portion of the axial length and around the periphery of said annular space, the second flow channel being separated from the first flow channel so that fluid flow does not pass therebetween, and the second flow channel having a second inlet and a second outlet.

2. The roll of claim 1, wherein the first flow channel further comprises:

a first seal having a cylindrical spiral path along the first portion of the length and around the periphery of said space from the first inlet to the first outlet, and the first seal extending between the outer shell and inner shell for sealing against fluid flow past the first seal.

3. The roll of claim 1, wherein the second flow channel further comprises:

a second seal having a circular path around the periphery of the annular space, and extending between the outer shell and inner shell for sealing against fluid flow past the second seal to separate fluid flow in the second flow channel from the first flow channel;

a third seal being spaced axially from the second seal, directed in a circular path around the periphery, and extending between the outer shell and inner shell for sealing against fluid flow past the third seal; and a transverse seal passing between the second inlet and second outlet, the transverse seal extending between the outer shell and inner shell for closing fluid flow between the second inlet and second outlet except by a circular path passing substantially around the periphery of the annular space of the second flow channel.

4. The roll of claim 3, further comprising:

a third flow channel located in said annular space and spaced axially from the first flow channel, the third flow channel extending along a third portion of the axial length and around the periphery of said annular space and being separated from fluid flow passing from the second flow channel, the third flow channel having a third inlet hydraulically connected to the first outlet of the first flow channel, and the third flow channel having a third outlet.

5. The roll of claim 4, wherein the third flow channel further comprises:

a fifth seal having a cylindrical spiral path along the third portion of the length and around the periphery of said annular space from the third inlet to the third outlet, and the fifth seal extending between the outer shell and inner shell for sealing against fluid flow past the fifth seal.

6. The roll of claim 5, wherein the first inlet has a union to connect to a first source of fluid.

7. The roll of claim 6, wherein the second inlet has a union to connect to a second source of fluid.

8. The roll of claim 1, wherein the first flow channel further comprises a first seal located in said space, the first seal being directed in a cylindrical spiral path along the first portion of the length and around the periphery from the first inlet to the first outlet, and the first seal extending between the outer shell and inner shell for sealing against fluid flow past the first seal; and the second flow channel further comprising:

a second seal having a circular path around the periphery of the annular space, and extending between the outer shell and inner shell for sealing against fluid flow past the second seal to separate fluid flow in the second flow channel from the first flow channel;

a third seal being spaced axially from the second seal, directed in a circular path around the periphery, and extending between the outer shell and inner shell for sealing against fluid flow past the third seal; and a fourth seal passing between the second inlet and second outlet, the fourth seal extending between the outer shell and inner shell for closing fluid flow between the second inlet and second outlet except by a circular path passing substantially around the periphery of the annular space of the second flow channel.

9. A heat transfer roll on which molten sheet material is processed, the roll comprising:

first and second journals supporting the roll for rotation about an axis;

a first end plate supported on, and secured to the first journal;

a second end plate spaced axially from the first end plate, supported on, and secured to the second journal;

a first cylindrical shell and a second cylindrical shell surrounding the first shell, the second cylindrical shell being secured to a radially outer periphery of the first and second end plates, the first and second cylindrical shells forming a closed cylindrical annular space between the first end plate and second end plate, and said annular space having an axial length and periphery;

a first flow channel located in said annular space, extending along a first portion of the axial length and around the periphery of said space, the first flow channel having a first inlet and a first outlet;

a first fluid path for carrying fluid to the first inlet;

a second flow channel located in said annular space, extending along a second portion of the axial length and around the periphery of said space, and the second flow channel having a second inlet and a second outlet, the second flow channel being separated from the first flow channel so that fluid flow does not pass therebetween; and a second fluid path for carrying fluid to the second inlet.

10. The roll of claim 9, wherein the first flow channel further comprises:

a first seal having a cylindrical spiral path from the first inlet to the first outlet and being within the first portion of the periphery and axial length of said annular space, and the first seal extending between the outer shell and inner shell for sealing against fluid flow past the first seal.

11. The roll of claim 10, wherein:

the first fluid path further comprises a first fluid passage formed in the first journal adapted for connection to a first fluid source, a first riser hydraulically connecting the first fluid passage and the first inlet, a second fluid passage formed in the second journal, and a second riser hydraulically connecting the second fluid passage and the first outlet; and the second fluid path further comprises a third fluid passage formed in the first journal adapted for connection to a second fluid source, a third riser hydraulically connecting the third fluid passage and the second inlet, a fourth fluid passage formed in the second journal, and a fourth riser hydraulically connecting the fourth fluid passage and the second outlet.

12. The roll of claim 10, further comprising:

a third flow channel located in said space and spaced axially from the first flow channel, the third flow channel extending along a third portion of the axial length and around the periphery of said annular space, the third flow channel having a third inlet and a third outlet; and a diverter axially extending along the length of said annular space, and the diverter being hydraulically connected between the first outlet and the third inlet.

13. The roll of claim 12, wherein the second flow channel further comprises:

a second seal located in said annular space, having a circular path around the periphery, and extending between the outer shell and inner shell for sealing against fluid flow past the second seal to separate fluid flow in the second flow channel from the first flow channel;

a third seal located in said annular space, spaced axially from the second seal, the third seal having a circular path around the periphery, and extending between the outer shell and inner shell for sealing against fluid flow past the third seal; and fourth seal located in said space between the second inlet and the second outlet, extending between the outer shell and inner shell for closing fluid flow between the second inlet and second outlet except along the second flow channel passing substantially around the periphery of said annular space.

14. The roll of claim 13, wherein the third flow channel further comprises:

a fifth seal having a cylindrical spiral from the third inlet to the third outlet and being within the third portion of the periphery and the axial length of said annular space, and the fifth seal extending between the outer shell and inner shell for sealing against fluid flow past the fifth seal.

15. The roll of claim 14, wherein the first fluid path further comprises:

a first fluid passage formed in the first journal adapted for connection to a first fluid source;

a first riser hydraulically connecting the first fluid passage and the first inlet;

a second fluid passage formed in the second journal; and a second riser hydraulically connecting the second fluid passage and the third outlet.

16. The roll of claim 15, wherein the second fluid path further comprises:

a third fluid passage formed in the first journal adapted for connection to a second fluid source;

a third riser hydraulically connecting the third fluid passage and the second inlet;

a fourth fluid passage formed in the second journal; and a fourth riser hydraulically connecting the fourth fluid passage and the second outlet.

17. A heat transfer roll on which sheet material is processed, the roll comprising:

a first cylindrical shell having an axis;

a second cylindrical shell surrounding the first shell, and the second shell defining a cylindrical annular space with the first cylindrical shell, said space having an axial length and a periphery;

a first flow channel located in said annular space, extending along a first portion of the axial length and around the periphery of said space, the first flow channel having a first inlet and a first outlet, the first inlet is adapted for connection to a first source of fluid;

a second flow channel located in said annular space, extending along a second portion of the axial length of said annular space, the second portion being adjacent said first portion, the second flow channel having a second inlet and a second outlet, the second inlet is adapted for connection to a second source of fluid; and a third flow channel located in said annular space, the third flow channel extending along a third portion of the axial length of said annular space, the third portion being adjacent said second portion, the third flow channel having a third inlet and a third outlet, the third inlet is hydraulically connected to the first outlet.

18. The roll of claim 17, wherein the first flow channel is cylindrically spiral and directed angularly about the axis and axially along the axis.

19. The roll of claim 17, wherein the first and third flow channels each being cylindrically spiral and directed angularly about the axis and axially along the axis.

20. The roll of claim 17, wherein:

the first and third flow channels are each cylindrically spiral and directed angularly about the axis and axially along the axis; and the second flow channel comprises a circular cylindrical channel located axially between the first and third flow channels.

* * * * *